United States Patent [19]

Kato et al.

[11] Patent Number: 4,709,392

[45] Date of Patent: Nov. 24, 1987

[54] DOME SPEAKER WITH A DIAPHRAGM HAVING AT LEAST ONE ELONGATED CUT-OUT PORTION

[75] Inventors: Toshiji Kato; Tatsuya Omori, both of Hirakata, Japan

[73] Assignee: Onkyo Kabushiki Kaisha, Osaka, Japan

[21] Appl. No.: 706,512

[22] Filed: Feb. 28, 1985

[30] Foreign Application Priority Data

| | | | |
|---|---|---|---|
| Mar. 8, 1984 | [JP] | Japan | 59-33872[U] |
| Mar. 9, 1984 | [JP] | Japan | 59-34748[U] |
| Mar. 9, 1984 | [JP] | Japan | 59-34749[U] |
| Mar. 14, 1984 | [JP] | Japan | 59-37168[U] |
| Jul. 3, 1984 | [JP] | Japan | 59-101190[U] |
| Jul. 3, 1984 | [JP] | Japan | 59-101191[U] |

[51] Int. Cl.[4] ..... H04K 7/02; H04K 7/18; H04K 7/24; H04K 9/02

[52] U.S. Cl. ..... 381/193; 181/157; 181/164; 181/168

[58] Field of Search ..... 179/115.5 ES, 115.5 R, 179/115 R, 181 R; 181/168, 157, 164; 381/193, 192, 202, 194

[56] References Cited

U.S. PATENT DOCUMENTS

| | | | |
|---|---|---|---|
| 2,085,073 | 6/1937 | Bostwick | 179/180 |
| 2,404,784 | 7/1946 | Bostwick | 381/158 |
| 2,974,204 | 3/1961 | Supitilor | 381/194 |
| 4,020,299 | 4/1977 | Garner et al. | 381/158 |
| 4,057,694 | 11/1977 | Obuchi | 381/194 |
| 4,433,214 | 2/1984 | Jasinski | 381/193 |

FOREIGN PATENT DOCUMENTS

| | | | |
|---|---|---|---|
| 52-31776 | 3/1977 | Japan | 179/181 R |
| 52-30419 | 3/1977 | Japan | 179/181 R |
| 52-67612 | 6/1977 | Japan | 181/168 |
| 53-26967 | 8/1978 | Japan | 181/168 |
| 54-21088 | 7/1979 | Japan | 181/168 |
| 54-155823 | 12/1979 | Japan | 179/101 |
| 55-39159 | 10/1980 | Japan | 179/181 R |
| 57-23391 | 2/1982 | Japan | 179/181 R |
| 57-93796 | 6/1982 | Japan | 179/115 R |
| 58-3500 | 1/1983 | Japan | 179/115 R |
| 2057224 | 3/1981 | United Kingdom | 179/181 R |

*Primary Examiner*—Gene Z. Rubinson
*Assistant Examiner*—Danita Byrd
*Attorney, Agent, or Firm*—Webb, Burden, Robinson & Webb

[57] ABSTRACT

A dome speaker comprising a dome-shaped diaphragm formed of a highly rigid material such as titanium or a titanium alloy, and having at least one elongated cut-out portion which varies the rigidity of the diaphragm and prevents a dip in the anti-resonance frequency range and a peak in the high resonance frequency range of the dome speaker. The speaker also includes a voice coil bobbin connected to the diaphragm. Preferably, the diaphragm includes two elongated cut-out portions in parallel relation to each other and with a center portion of the diaphragm interposed therebetween. A reinforcing rib may be integrally formed at an end of each cut-out portion. The cut-out portion may be covered either by a peripheral member made of a soft material or by a loss stopper formed of a viscoelastic material.

8 Claims, 29 Drawing Figures

(a)

DOME SPEAKER WITH A DIAPHRAGM HAVING AT LEAST ONE ELONGATED CUT-OUT PORTION

BACKGROUND OF THE INVENTION

This invention relates to a loudspeaker and more particularly to improvements in a dome speaker in the field of electric sound apparatus.

As shown in FIGS. 28 and 29 of the accompanying drawings, the dome speaker of the prior art generally comprises a magnet 11', center pole 12', a front plate 13', a back plate 14', a diaphragm 15', a voice coil 16' mounted on a bobbin 16a' secured to the outer periphery of the diaphragm 15' and disposed in a magnetic space between the center pole 12' and the front plate 13', and an edge 5' supporting the diaphragm 15'. The voice coil 16' is energized with audio currents to activate the diaphragm 15' whereby sound waves are radiated.

The diaphragm 15' is in most cases formed of a light and highly rigid material such as duralumin in order to maximize partial vibration frequency to produce excellent frequency characteristics. Other known dome speakers, so-called soft dome speakers, use a soft material for the diaphragm involving a great internal loss.

Of the examples noted above, the diaphragm formed of a highly rigid material involves a small mechanical internal loss in the diaphragm material. Therefore, in a frequency range higher than the piston vibration range, the vibrating energy conducted from peripheries of the diaphragm and the vibrating energy reverberated from the center of the diaphragm interfere with each other thereby to create a nodal line to anti-resonance adjacent the outer peripheries of the diaphragm. Since the vibrations of the diaphragm are in opposite phases across the nodal line, a dip is formed in the anti-resonance frequency in the frequency characteristics, and a peak is formed in a subsequent high resonance frequency range. This deteriorates the frequency characteristics and transient characteristics to the detriment of aural quality.

In the case of the known soft dome speaker, although the diaphragm is relatively free from resonance and anti-resonance because of the great internal loss, the large mass of the diaphragm and the difficulty in conducting vibrating energy render the speaker very inefficient in energy conversion.

SUMMARY OF THE INVENTION

With regard to the disadvantages of the prior art noted above, this invention has for an object to provide a dome speaker having excellent frequency characteristics and energy conversion efficiency by employing an improved vibration system which is effective to prevent anti-resonance.

In order to achieve the above object a dome speaker according to this invention comprises a dome-shaped diaphragm formed of a highly rigid material, a voice coil bobbin operatively connected to the diaphragm, said diaphragm having at least one elongated cut-out portion to vary the rigidity of the diaphragm.

The provision of an elongated cut-out portion to vary the rigidity of the diaphgram in the above vibration system results in positional vibrations in the circumferential direction in the rigidity of outer peripheries of the center portion of the diaphragm which is the main source of sound radiation. Therefore, any conspicuous anti-resonance and resonance in the anti-resonance frequency range and the high resonance frequency range encountered in the prior art are scattered out according to this invention. Moreover, partial vibrations of a high order at the center portion of the diaphragm are checked by peripheral members, thereby eliminating dips and peaks in the frequency characteristics attributable to the partial vibrations and producing flat frequency characteristics. At the same time, conspicuous resonance is eliminated resulting in excellent transient characteristics and a significantly improved quality of reproduced sound.

Other advantages of this invention will be apparent from the following description.

BRIEF DESCRIPTION OF THE DRAWINGS

The drawings show dome speakers embodying the present invention, in which.

DESCRIPTION OF THE PREFERRED EMBODIMENTS

The invention will be described further with reference to the drawings illustrating embodiments. Like numerals are affixed to like components, and part of common or overlapping constructions will not be described repeatedly.

(First Embodiment)

Figure 1:
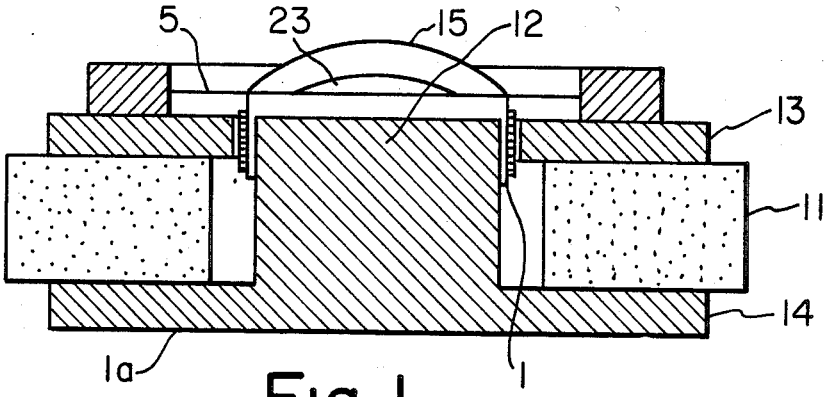
FIG. 1 is a side view in vertical section of a principal portion of a speaker according to a first embodiment of the invention.

Referring to FIG. 1, the basic construction of a dome speaker according to the first embodiment comprises a magnet 11, a center pole 12, a front plate 13, a back plate 14, a diaphragm 15, a voice coil 1 secured to an outer periphery of the diaphragm 15 and disposed in a magnetic space between the center pole 12 and the front plate 13, a coil bobbin 1*a* carrying the voice coil 1, and an edge 5 supporting the diaphragm 15. The voice coil 1 is energized with audio currents to activate the diaphragm 15 and thereby radiate sound waves.

Figure 2:
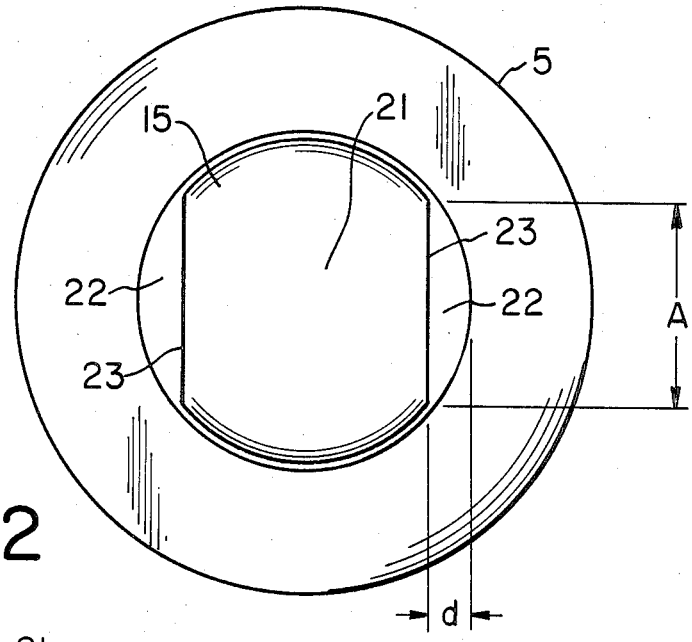
FIG. 2 is a plan view of a diaphragm.
Figure 3:
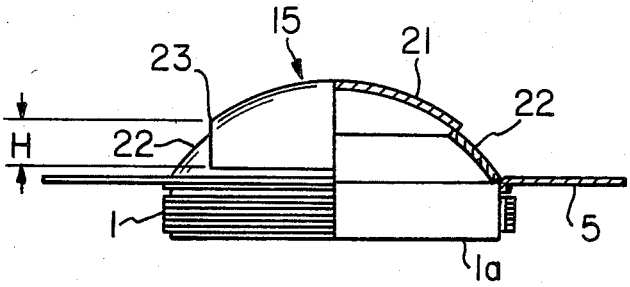
FIG. 3 is a front view partly in section of the diaphragm of FIG. 2.
Figure 4:
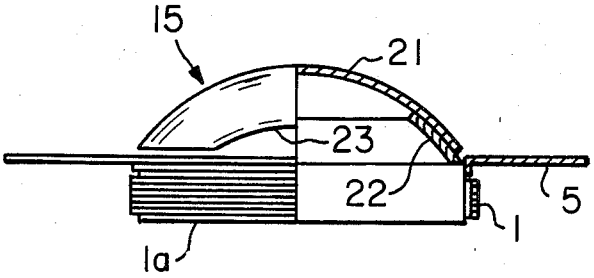
FIG. 4 is a side view partly in section of the diaphragm of FIG. 2.

As shown in FIGS. 1 through 3, the diaphragm 15 of this dome speaker comprises a center portion 21 formed of a lightweight and yet highly rigid material such as duralumin, a titanium alloy or like metal or plastic reinforced with highly rigid fibers or films, and peripheral members 22 formed of a soft material such as cloth, paper, cloth coated with a viscoelastic material, or soft plastic. The center portion 21 defines two elongated cut-out portions 23 at peripheral positions thereof which act as vibration means to vary the rigidity of the diaphragm 15. As illustrated, the two cut-out portions 23 are symmetrical and formed in parallel relation to each other. Alternatively, the diaphragm 15 may be provided with one elongated cut-out portion only.

Each peripheral member 22 consists a sheet defining a substantially identical curved surface to the curved surface of the center portion 21 of the diaphragm 15. The peripheral members 22 close the cut-out portions 23 of the center portion 21 and are joined with the voice coil 1 at the outer peripheries of same. Thus the peripheral members 22 are interposed between the center portion 21 of the diaphragm 15 and the voice coil 1.

Test results show that each cut-out portion 23 should preferably have a width A on the order of 3–33 percent of the total circumferential length of the center portion 21, a radial depth d on the order of 1–50 percent of the radius, and a height H on the order of 10–80 percent of the total height of the center portion 21. There may be one or more cut-out portions 23. The cut-out portion or portions 23 produce the same effect regardless of its shape. Hence, the cut-out portions may be arcuate or linear.

Figure 5:
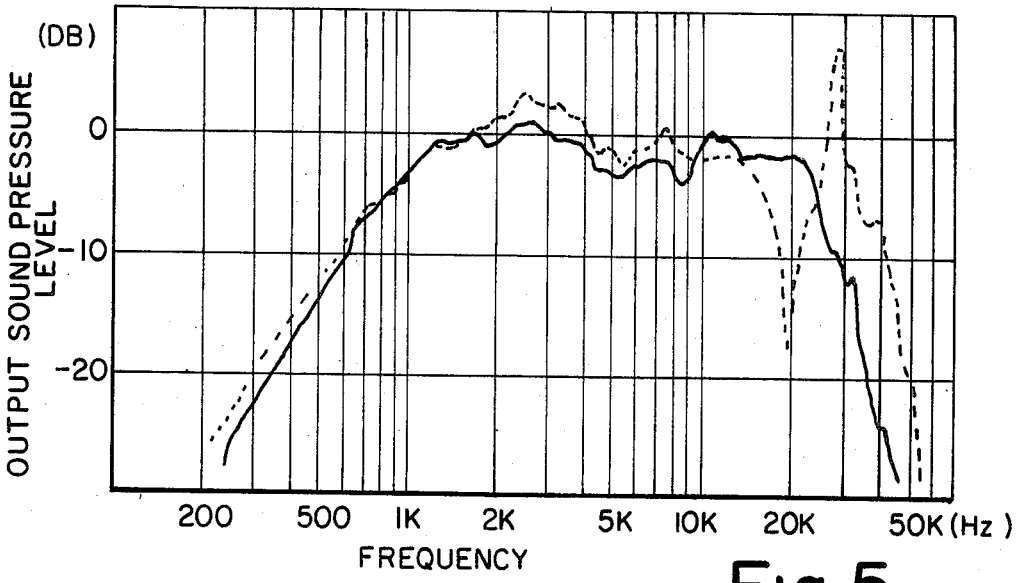
FIG. 5 is a graph showing frequency characteristics of the speaker according to the first embodiment.

The peripheral members 22 may be formed of a different material than the edge 5. Alternatively, the peripheral members may be made of the same material as and be integrally formed with the edge 5 (though not shown as such in the drawings). It is ncecessary that the peripheral members 22 be sufficient in size to cover the cut-out portions 23 and spaces between the voice coil bobbin 1*a* and the outer peripheries of the center portion 21 of the diaphragm 15. FIG. 5 shows the frequency characteristics of the dome speaker according to this embodiment in a solid line as compared to those of a known speaker, represented by the dotted line. As seen, the frequency characteristics of the known speaker have a dip due to anti-resonance at about 20 KHz and a peak due to high frequency resonance at about 30 KHz. On the other hand, the dome speaker of this invention involves no peak or dip in those frequency ranges. It will be clear that the vibration system according to this invention is effective to level out conspicuous resonance and anti-resonance.

Moreover, the dome speaker according to this invention comprises a diaphragm formed of a hard material which is nevertheless lighter than a soft dome diaphragm. Therefore, the diaphragm herein has a high energy conversion efficiency. The speaker according to this invention has excellent frequency characteristics and transient characteristics never expected from the prior art.

(Second Embodiment)

Figure 6:
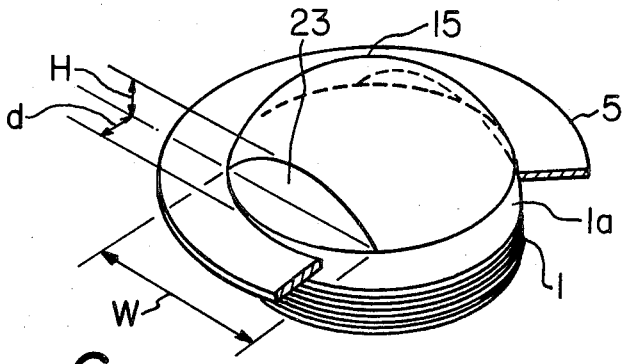
FIG. 6 is a perspective view of a dome speaker according to a second embodiment of the invention.

Referring to FIG. 6, the basic vibration system of a dome speaker according to the second embodiment comprises a diaphragm 15 formed of a hard material which is lightweight and yet highly rigid, such as duralumin, a titanium alloy or like metal or plastic reinforced with a highly rigid filler in fibrous, flake or powdery form. The diaphragm 15 defines two cut-out portions 23 in parallel relation to each other and at peripheral positions. Although two symmetric cut-out portions are provided in the illustrated example, one cut-out portion alone will serve the same purpose.

The purpose of the cut-out portions 23 is to render uneven the rigidity of the diaphragm 15 in order to level out a pronounced nodal line of vibration occurring adjacent the peripheries of the diaphragm 15. Test results show that the dimensions of the cut-out portions 23 should desirably be the same as in the first embodiment. The second embodiment differs from the first embodiment in that there are no sheet-like peripheral members 22 covering the cut-out portions 23 in the second embodiment.

Figure 7:
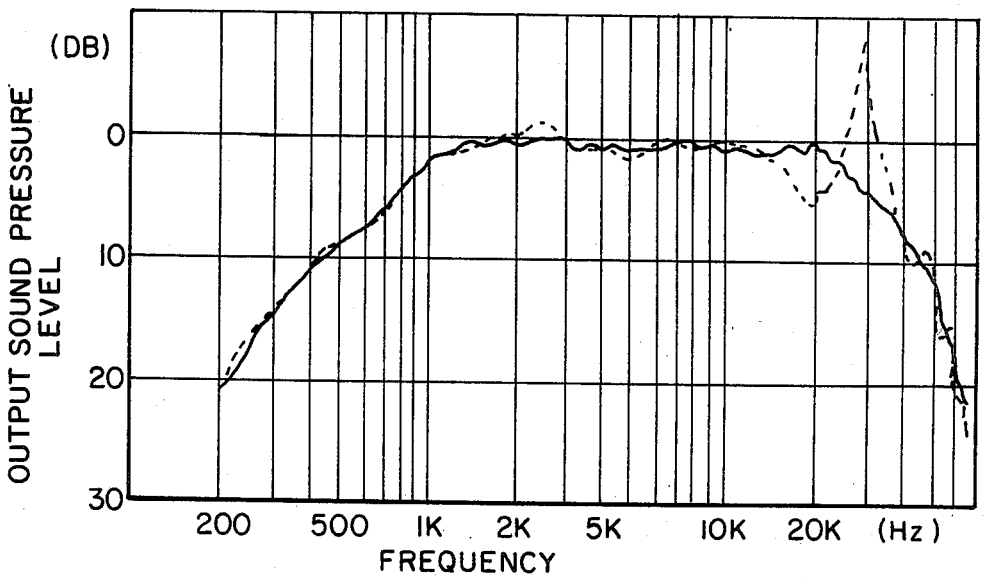
FIG. 7 is a graph showing frequency characteristics of the speaker according to the second embodiment.

FIG. 7 shows frequency characteristics of the dome speaker according to the second embodiment as represented by a solid line. The dotted line represents frequency characteristics of a known speaker. As seen, the frequency characteristics of the known speaker have a dip due to anti-resonance at about 20 KHz and a peak due to high frequency resonance at about 30 KHz. On the other hand, the dome speaker of this embodiment involves no peak or dip in those frequency ranges. It will be clear that the vibration system according to this embodiment is effective to level out conspicuous resonance and anti-resonance.

(Third Embodiment)

Figure 8:
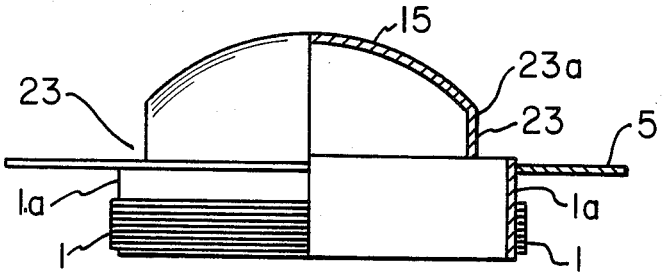
FIG. 8 is a front view partly in section of a diaphragm of a dome speaker according to a third embodiment of the invention.
Figure 9:
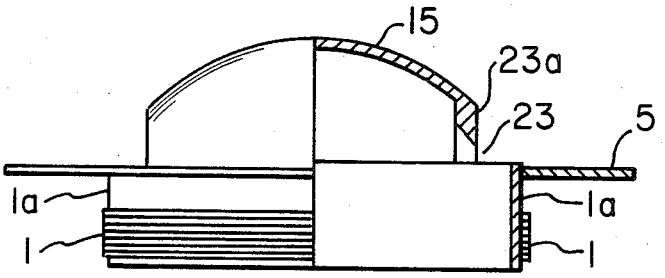
FIG. 9 is a front view partly in section of a modification of the diaphragm shown in FIG. 8.

As shown in FIGS. 8 and 9, the diaphragm 15 is provided with reinforcement ribs 23*a* at ends of cut-out portions 23. This construction is effective to prevent the ends of the cut-out portions 23 from abnormally vibrating as free ends. Thus, the diaphragm 15 according to this embodiment has excellent frequency characteristics as in the preceding embodiment and at the same time has the advantage of preventing abnormal vibrations thereby promoting aural quality.

In FIG. 8, diaphragm 15 is formed of a metal and the reinforcement ribs 23*a* may advantageously be formed integral therewith by bending at times of press shaping. When diaphgram 15 is formed of a plastic material as in FIG. 9, the ends of the cut-out portions 23 may readily be shaped to have a larger thickness than the rest of the diaphragm.

(Fourth Embodiment)

Figure 10:
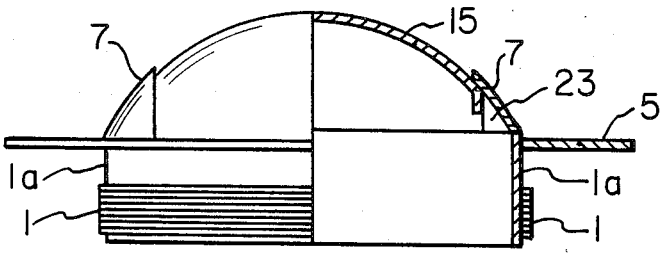
FIG. 10 is a front view partly in section of a diaphragm according to a fourth embodiment of the invention.

The embodiment shown in FIG. 10 further comprises viscoelastic members 7 closing the spaces between the cut-out portions 23 of the diaphragm 15 and inner peripheries of the edge 5 or the top parts of the voice coil bobbin 1*a*. Thus the dome speaker according to this embodiment further improves transient characteristics by preventing the leakage of air present behind the diaphragm 15 and by reducing material internal loss. These viscoelastic members 7 may be formed as separate bodies or may comprise a soft material such as cloth containing or coated with a viscoelastic material and formed integral with the edge 5.

As a simple modification of this embodiment, the diaphragm 15 and the edge 5 may be an integral formation of the same material.

(Fifth Embodiment)

Figure 11:
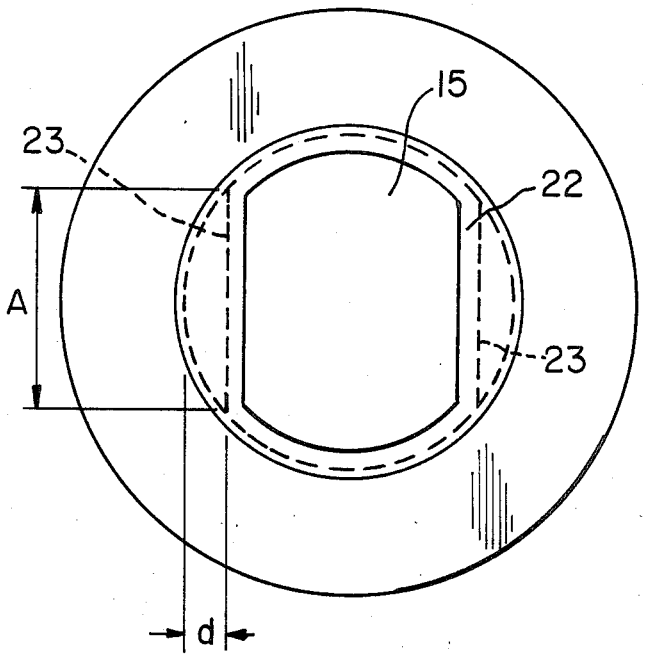
FIG. 11 is a plan view of a diaphragm according to a fifth embodiment of the invention.
Figure 12:
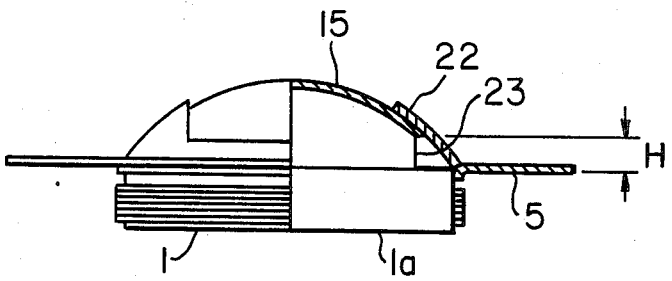
FIG. 12 is a front view partly in section of the diaphragm shown in FIG. 11.
Figure 13:
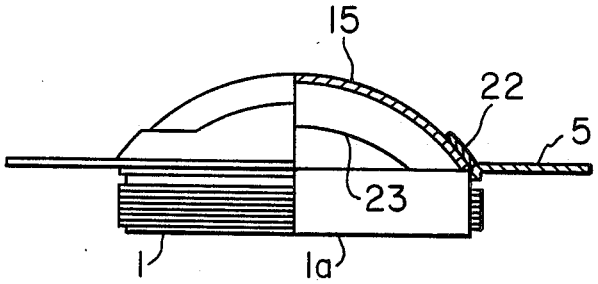
FIG. 13 is a side view partly in section of the diphragm shown in FIG. 11.

Referring to FIGS. 11 through 13, the dome speaker according to this embodiment comprises a diaphragm 15 formed of a hard, yet lightweight and highly rigid material such as duralumin, a titanium alloy or like metal or plastic reinforced with highly rigid fibers or films, and peripheral members 22 formed of a soft material such as cloth, paper, cloth coated with a viscoelastic material, or soft plastic. The diaphragm 15 defines cut-out portions 23 at two peripheral positions thereof.

The dome speaker of this embodiment further comprises a voice coil 1 carried by a bobbin 1*a*, which is known per se. The peripheries of the diaphragm 15 are joined to the top of the bobbin 1*a* where the cut-out portions 23 are not formed.

The cut-out portions 23 are closed by the soft peripheral members 22 to establish an airtight seal between the inside and outside of the diaphragm 15.

Test results show that each cut-out portion 23 should preferably have a width A on the order of 3–33 percent of the total circumferential length of the diaphragm 15, a radial depth d on the order of 1–50 percent of the radius, and a height H on the order of 10–80 percent of a total height of the diaphragm 15. Each speaker may include one or more cut-out portions 23. Preferably, the peripheral members 22 are sufficient in size to completely cover the cut-out portions 23 as shown in FIGS. 12 and 13.

The peripheral members 22 may be formed of a different material than the edge 5 or may be made of the same material and formed integral with the edge 5. The cut-out portions 23 produce the same effect regardless of their shape. Hence, they may be symmetrical or dissimilar, arcuate or linear.

Figure 14:
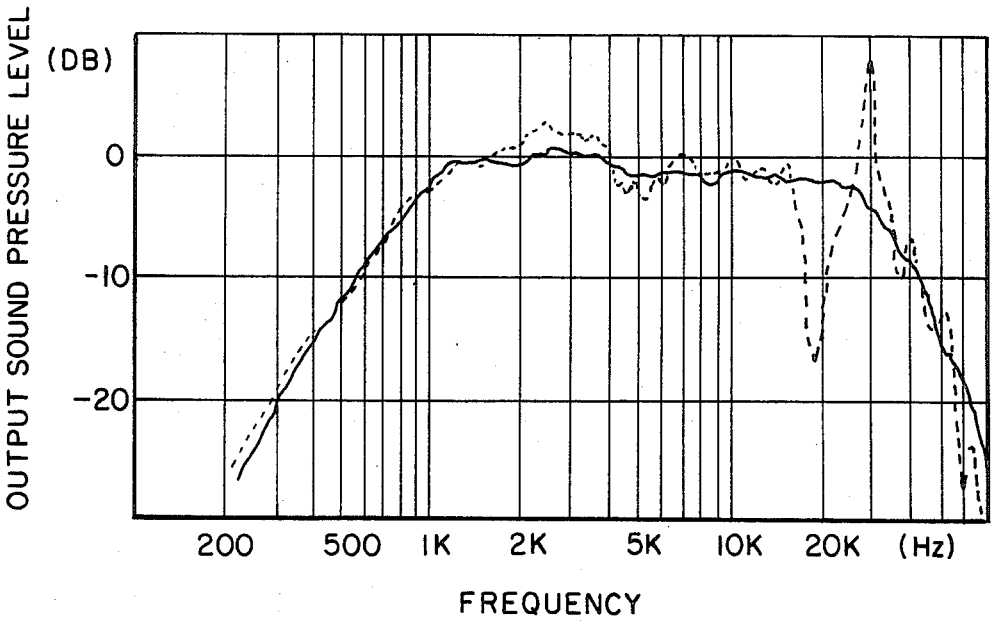
FIG. 14 is a graph showing frequency characteristics of the dome speaker according to the fifth embodiment.

FIG. 14 shows frequency characteristics of the dome speaker according to the fifth embodiment in a solid line as compared with those of a known dome speaker, represented by a dotted line. As seen, the frequency characteristics of the known speaker have a dip due to anti-resonance at about 20 KHz and a peak due to high frequency range resonance at about 30 KHz. The dome speaker according to this embodiment contains no peak or dip in those frequency ranges. It will be clear that the vibration system according to this embodiment is effective in leveling out conspicuous resonance and anti-resonance. Moreover, the internal loss in the soft material of the peripheral members 22 promotes flat or planar characteristics and excellent transient characteristics thereby improving aural quality to a great extent.

The dome speaker according to this embodiment comprises a diaphragm formed of a hard material which is lighter than a soft dome diaphragm. Therefore, this diaphragm has a high energy conversion efficiency. The speaker according to this embodiment has excellent frequency characteristics and transient characteristics never expected from the prior art.

(Sixth Embodiment)

Figure 15:
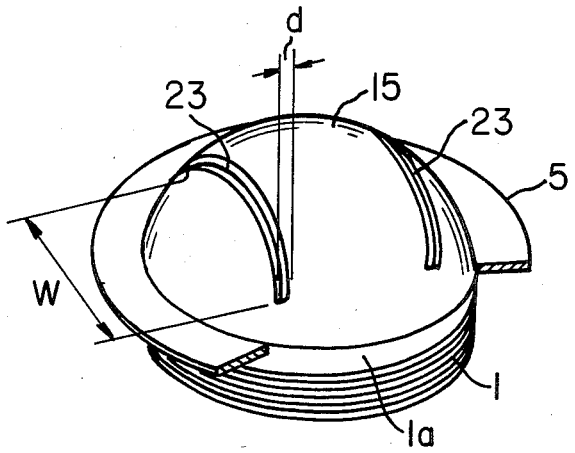
FIG. 15 is a perspective view of a diaphragm according to a sixth embodiment of the invention.

As shown in FIG. 15, the diaphragm 15 of this embodiment comprises titanium formed into a desired dome shape, said dome having two slits 23 adjacent peripheries thereof. The material for the diaphragm 15 may be selected from other lightweight, high rigid, yet hard substances including metals other than titanium, synthetic resins and resins reinforced with highly rigid fillers in fiber, flake or powder form.

The slits are sized, including the nodal line, to fall in the high resonance frequency range. Test results show that each slit should preferably have a width W on the order of 3–50 percent of a total circumferential length of the diaphragm and a radial width d ranging from a minimum that would constitute a cut to a maximum of about 50 percent of the radius of the diaphragm. There should be from one to five slits in number to produce good results (the illustrated example comprises two elongated, symmetrical slits).

The slits 23 need not have the linear shape as shown. Each slit may be in an arc shape parallel to or opposed to the periphery of the diaphragm. Alternatively, the slits may be curved in any manner. The slits may also be shaped to include part of the nodal line in the high resonance frequency range.

The sixth embodiment comprises a voice coil 1 wound around a voice coil bobbin 1*a* to provide a driving force and an edge 5 to support the vibration system. These elements are identical to the respective counterparts in the dome speakers of the preceding embodiments.

Figure 16:
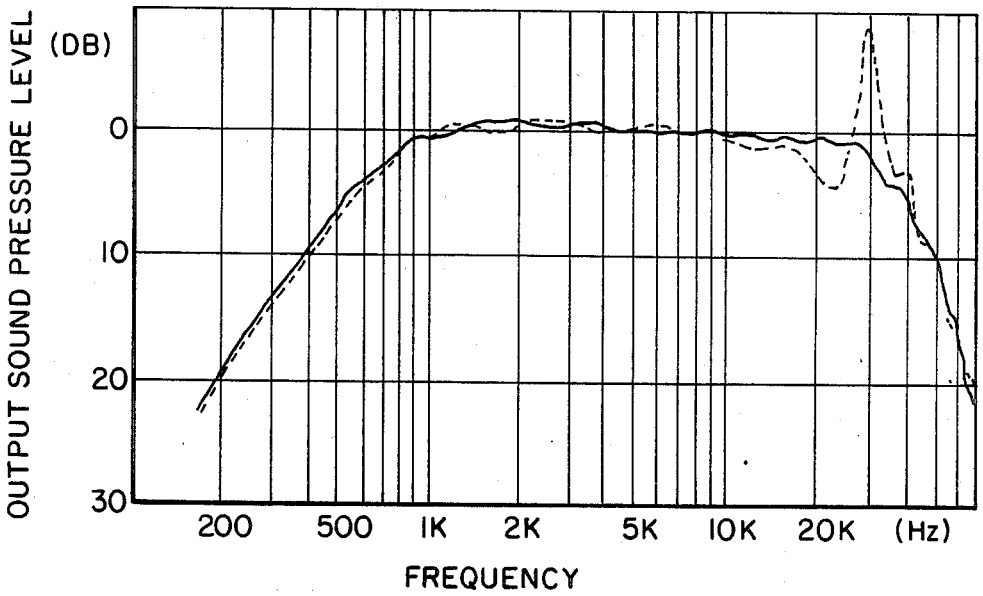
FIG. 16 is a graph showing frequency characteristics of the dome speaker according to the sixth embodiment.

The solid line in FIG. 16 represents the frequency characteristics of the dome speaker according to this embodiment. The speaker which was tested included a diaphragm with a 25 mm diameter having slits with a 10 mm width W and a 2 mm radial width d. The dotted line in FIG. 16 represents the frequency characteristics of a known dome speaker which included a diaphragm with the same diameter as the diaphragm above.

(Seventh Embodiment)

Figure 17:
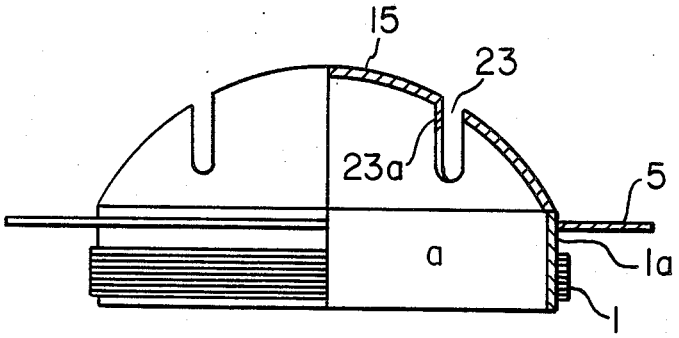
FIG. 17 is a front view partly in section of a diaphragm according to a seventh embodiment of the invention.
Figure 18:
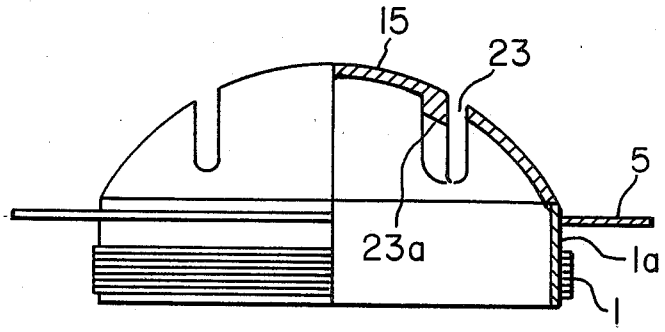
FIG. 18 is a front view partly in section of a modification of the diaphragm shown in FIG. 17.

The diaphragm 15 shown in FIGS. 17 and 18 includes a pair of elongated slits 23, each slit provided with a reinforcing rib 23*a* on the side closet to the center of the diphragm 15. Reinforcing ribs may be provided on the opposite sides only or on both sides of each slit as well. When the diaphragm 15 is formed of a synthetic resin or a reinforced synthetic resin, the peripheries of the slits 23 may be larger in thickness to form integral reinforcing ribs 23*a*.

The reinforcing ribs 23*a* defined peripherally of the slits 23 are effective in preventing the portions of the diaphragm 15 adjacent the peripheries of the slits from acting as free ends and from vibrating at high frequency. The addition of these ribs 23*a* flatten the frequency characteristics of this speaker.

(Eighth Embodiment)

Figure 19:
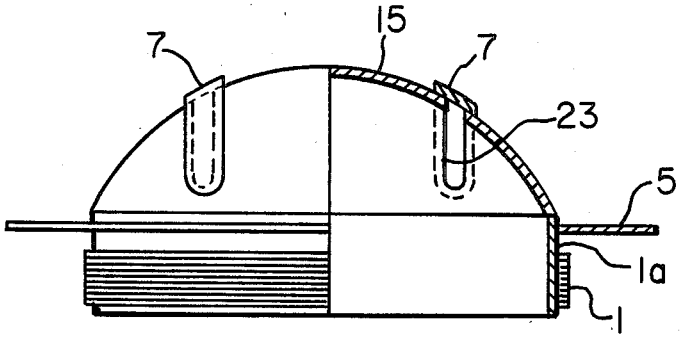
FIG. 19 is a front view partly in section of a diaphragm according to an eighth embodiment of the invention.

The diaphragm 15 shown in FIG. 19 further comprises a plurality of loss stoppers 7 made of a viscoelastic material affixed to the peripheries thereof, including slits 23. These loss stoppers 7 seal the slits 23 in order to prevent the flow of air out from behind the diaphragm 15. This construction has the advantage of checking high frequency partial vibrations of the diaphragm to further improve its frequency characteristics and transient characteristics. In addition, the edge 5 formed of a soft material may include inner peripheries which partially extend along the diaphragm and cover the slits 23.

(Ninth Embodiment)

Figure 20:
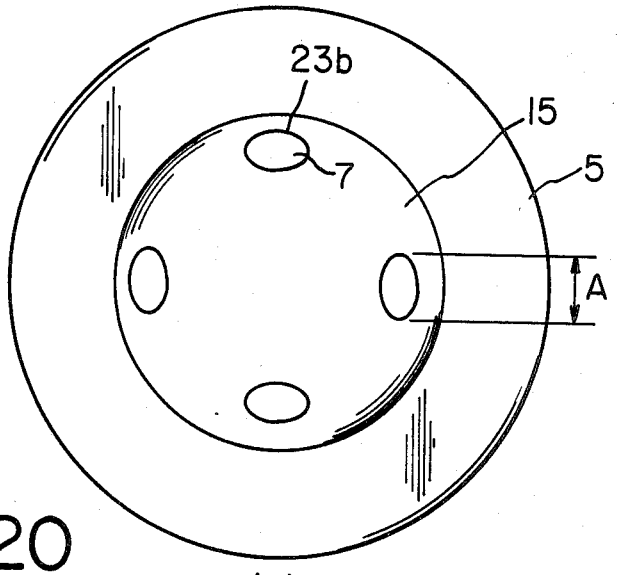
FIG. 20 is a plan view of the diaphragm according to a ninth embodiment of the invention.
Figure 21:
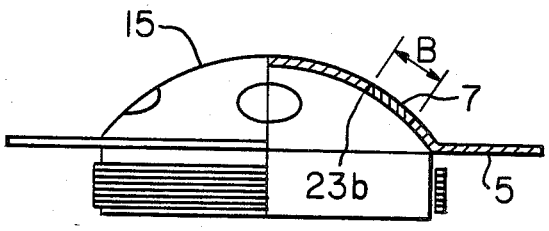
FIG. 21 is a front view partly in section of the diaphragm shown in FIG. 20.

The diaphragm 15 of a dome speaker according to this embodiment comprises a metal, ceramic or plastic dome portion which defines a plurality of apertures 23*b* distributed adjacent the peripheries thereof. As shown in FIGS. 20 and 21, four apertures are distributed adjacent the nodal line in the high resonance frequency range. However, one such aperture may also be sufficient. The plurality of apertures 23*b* in the illustrated examples are filled with or covered by viscoelastic members 7, having a mechanical internal loss, to close the apertures 23*b*.

Tests conducted on the shape and arrangement of the apertures 23*b* show that each aperture should desirably have a width A on the order of 2–40 percent of the total circumferential length of the dome portion, and a width B on the order of 8–50 percent of the radius of the dome portion. The apertures 23*b* should desirably be arranged about 2–30 percent radially inwardly from the periphery of the dome portion. The apertures may or may not be in a radially symmetric arrangement. For that matter, the apertures need not be identical to each other in size and shape. In some cases, a diaphragm having apertures with varied shapes is more effective in distributing resonance than one having apertures with the same shape.

Figure 22:
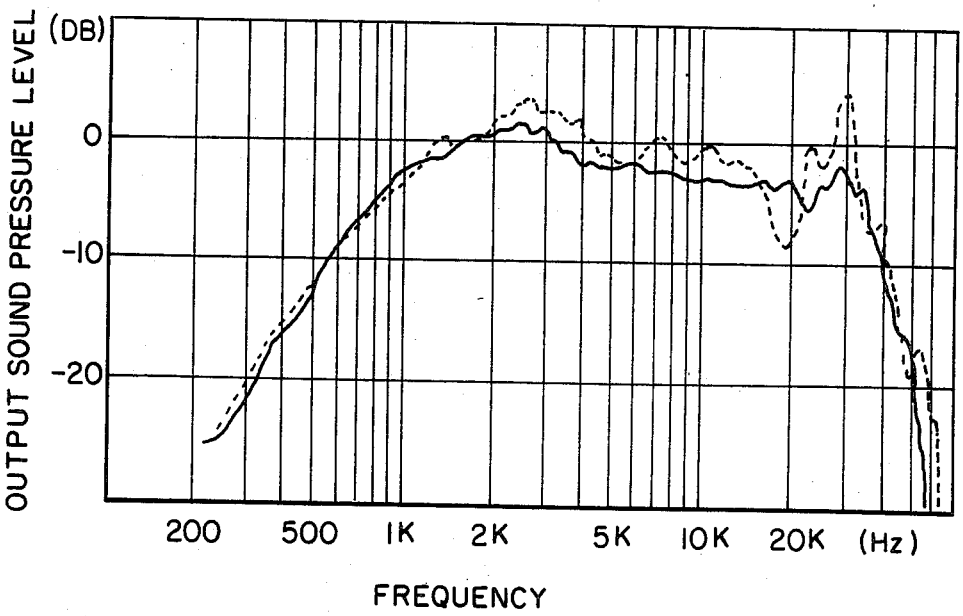
FIG. 22 is a graph showing frequency characteristics of the dome speaker according to the ninth embodiment.

The diaphragm 15 of the dome speaker according to this embodiment has a rigidity of positions where the nodal line in the high resonance frequency range adjacent the periphery of the diaphragm appears positionally varied by the apertures in the scattered arrangement. The above construction does not permit a conspicuous nodal line in the high resonance frequency range to occur on the diaphragm, whereby peaks and dips are levelled out in the frequency characteristics. Thus, as seen in FIG. 22, the frequency characteristics as represented by a solid line are flatter than those of a prior art speaker as shown by a dotted line. The flat frequency characteristics of this embodiment are further promoted in the controlling of the internal loss by the presence of viscoelastic members adjacent each aperture. At the same time, the above described construction produces excellent transient characteristics to greatly improve aural quality.

The diaphragm of this embodiment also includes a dome portion formed of a hard material which is nevertheless lighter than a soft dome diaphragm. Hence, this dome speaker has a high energy conversion efficiency. The speaker according to this embodiment has excellent frequency characteristics and transient characteristics never expected from the prior art.

(Tenth Embodiment)

Figure 23:
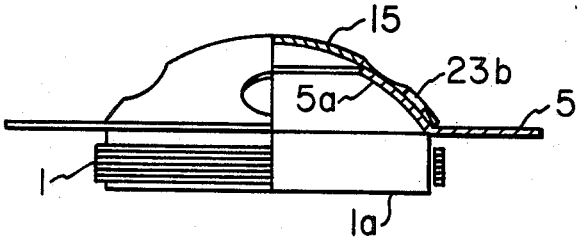
FIG. 23 is a front view partly in section of a diaphragm according to a tenth embodiment of the invention.

This embodiment constitutes an improvement on the ninth embodiment. The diaphragm 15 comprises the free edge type in which the edge 5 is formed of a separate material such as woven fabric or unwoven fabric to which a viscous substance is applied. The edge material may also be a soft plastic. As shown in FIG. 23, the edge 5 includes extensions 5*a* extending from an inner periphery along the dome portion of the diaphragm. The extensions 5*a* are used to join the edge 5 and the dome portion and may at the same time close the apertures 23*b*.

The diaphragm 15 of this embodiment is formed of titanium and has a dome shape having a 20 mm thickness, a 25 mm diameter, and a 16–31 mm radius of curvature. The apertures 23*b* and the extensions 5*a* closing the apertures 23*b* have exactly the same function and effect as the apertures and the viscoelastic members in the ninth embodiment. Because the apertures in this embodiment are closed with extensions 5*a*, a damping effect is produced simply by adhering the edge to the diaphragm. Therefore, this embodiment dispenses with the trouble (or separate step) of filling or covering each aperture with a viscoelastic member as required in the ninth embodiment. This results in reduced manufacturing costs for the speaker of the tenth embodiment.

(Eleventh Embodiment)

Figure 24:
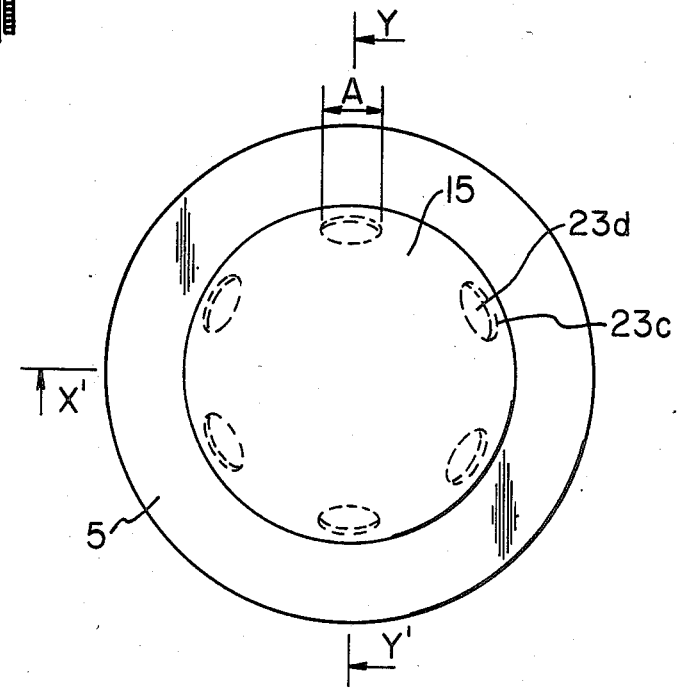
FIG. 24 is a plan view of the diaphragm according to an eleventh embodiment of the invention.
Figure 25:
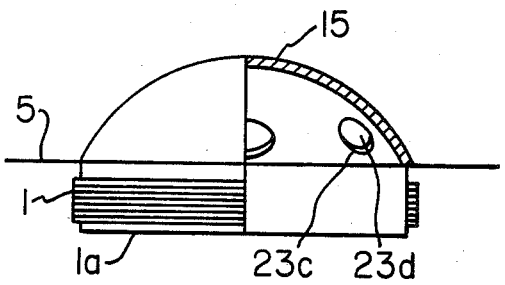
FIG. 25 is a front view partly in section of the diaphragm shown in FIG. 24.
Figure 26:
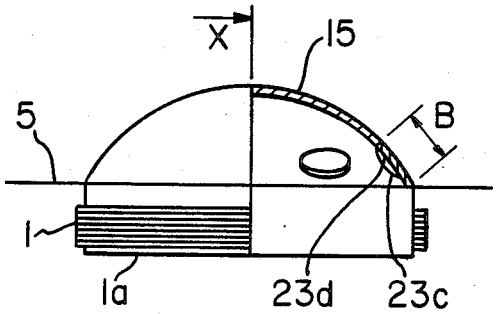
FIG. 26 is a side view partly in section of the diaphragm shown in FIG. 24.

Referring to FIGS. 24 through 26, the dome speaker according to this embodiment comprises a diaphragm 15 formed of a synthetic resin alone or a synthetic resin mixed with carbon fibers, graphite or other highly rigid fillers. The diaphragm 15 defines small recesses 23*c* at six positions adjacent the peripheries of its dome portion including the nodal line in the high resonance frequency range. These recesses 23*c* are formed in an inner wall of the dome portion thereby defining thin material portions 23*d* in the dome wall. Alternatively, one recess alone may be provided instead of the plurality of recesses 23*c* illustrated.

Figure 27:
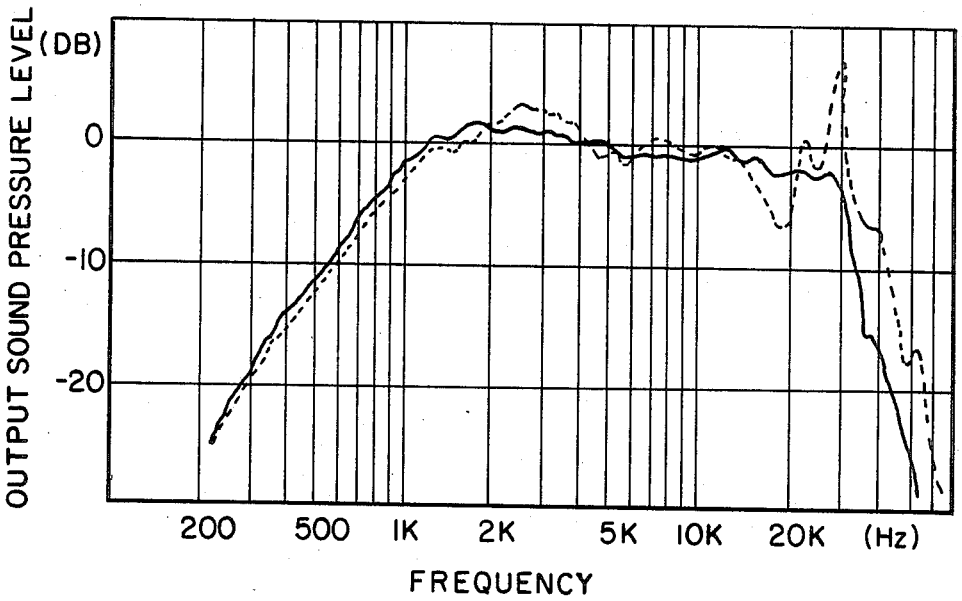
FIG. 27 is a graph showing frequency characteristics of the dome speaker according to the eleventh embodiment.
Figure 28:
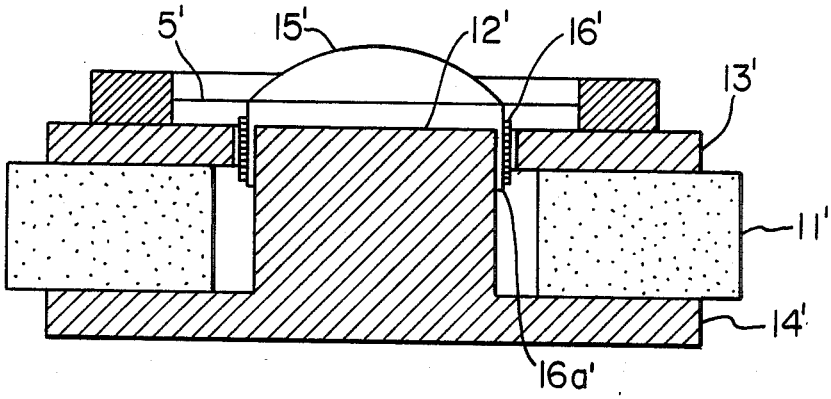
Fig. 28 PRIOR ART
FIG. 28 is a side view in vertical section of principal portion of a dome speaker according to the prior art.
Figure 29:
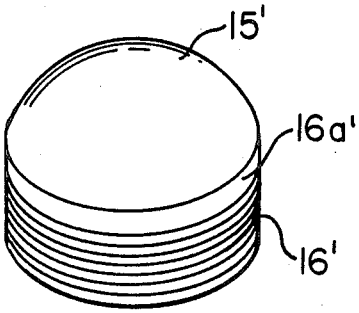
Fig. 29 PRIOR ART
FIG. 29 is a perspective view of a diaphragm shown in FIG. 28.

The construction of this embodiment has a rigidity of positions where the nodal line in the high resonance frequency range adjacent the periphery of the diaphragm appears positionally varied. This construction does not permit a conspicuous nodal line in the high resonance frequency range to occur on the diaphragm, whereby peaks and dips are levelled out in the frequency characteristics. Thus, as seen in FIG. 27, the frequency characteristics as represented by a solid line are flatter than those of a prior art speaker represented by a dotted line.

The diaphragm herein has a central portion which is formed of a hard material but is nevertheless lighter than a soft dome diaphragm. Hence, this diaphragm has a high energy conversion efficiency. The speaker according to this embodiment has excellent frequency characteristics and transient characteristics never expected from the prior art.

The small recesses 23*c* of this embodiment may be filled with a viscous substance to constrain anti-resonance and to increase apparent internal loss at the positions of the diaphragm where the nodal line appears.

Tests conducted on the shape and arrangement of the small recesses 23*c* show that each recess should desirably have a width A on the order of 2–40 percent of the total circumferential length of the dome portion and a width B on the order of 8–50 percent of the radius of the dome portion. The recesses themselves should desirably be arranged about 2–30 percent radially inwardly from the periphery of the dome portion. The recesses may or may not be in a radially symmetric arrangement or identical to each other in size and shape. In certain cases, a diaphragm having recesses with varied shapes is more effective in distributing resonance than one having recesses with the same shape.

It will be noted that the technical concept of this invention is not limited to the specific constructions of the first to eleventh embodiments described in this specification.

What is claimed is:

1. A dome speaker comprising a dome-shaped diaphragm and a voice coil bobbin connected to the diaphragm, said diaphragm formed of a highly rigid material and having two elongated cut-out portions therein aligned in parallel relation to each other and having a center portion of said diaphragm interposed therebetween, wherein said cut-out portions vary the rigidity of the diaphragm and prevent a dip in the anti-resonance frequency range and a peak in the high resonance frequency range of the dome speaker.

2. A dome speaker as claimed in claim 1 wherein said cut-out portions are symmetrical.

3. A dome speaker as claimed in claim 1 further including a peripheral member attached to the diaphragm and closing at least part of at least one of the cut-out portions, said peripheral member being formed of a soft material and secured to the diaphragm at the voice coil bobbin.

4. A dome speaker as claimed in claim 1 further including a reinforcement rib integrally formed at an end of at least one of the cut-out portions.

5. A dome speaker as claimed in claim 1 further including a viscoelastic loss stopper at least partially covering at least one of the cut-out portions.

6. A dome speaker as claimed in claim 1 further including an edge integrally formed with the diaphragm.

7. A dome speaker as claimed in claim 1 wherein the diaphragm is formed of titanium.

8. A dome speaker as claimed in claim 1 wherein the diaphragm is formed of a titanium alloy.

* * * * *